US005819972A

United States Patent [19]

Puente Pubill

[11] Patent Number: 5,819,972

[45] Date of Patent: Oct. 13, 1998

[54] CONTAINER FOR BEVERAGES, PRESERVED FOODS AND THE LIKE

[75] Inventor: Gustavo Puente Pubill, Caldes de Montbui, Spain

[73] Assignee: Investigacion, Desarrollo, Creacion Y. Mejora De Productos, S.L., Caldes de Montbui, Spain

[21] Appl. No.: 604,982

[22] PCT Filed: Jul. 19, 1995

[86] PCT No.: PCT/ES95/00089

§ 371 Date: Mar. 13, 1996

§ 102(e) Date: Mar. 13, 1996

[87] PCT Pub. No.: WO96/03331

PCT Pub. Date: Feb. 8, 1996

[30] Foreign Application Priority Data

| | | | |
|---|---|---|---|
| Jul. 22, 1994 | [ES] | Spain | 9401620 |
| Feb. 8, 1995 | [ES] | Spain | 9500246 |
| Jul. 14, 1995 | [ES] | Spain | 9501414 |

[51] Int. Cl.[6] ..... B65D 41/32; B65D 51/18

[52] U.S. Cl. ..... 220/255; 220/270; 220/705; 220/707; 220/708

[58] Field of Search ..... 220/705, 707, 220/708, 709, 714, 717, 720, 721, 257, 271, 276, 360, 367.1, 666, 667, 255, 256, 266, 265, 270

[56] References Cited

U.S. PATENT DOCUMENTS

| | | | |
|---|---|---|---|
| 3,133,669 | 5/1964 | Scholtz | 220/257 X |
| 3,149,743 | 9/1964 | Scholtz | 220/257 |
| 3,156,374 | 11/1964 | Scholtz | 220/257 |
| 3,298,577 | 1/1967 | Chlystun | 220/707 X |
| 3,547,308 | 12/1970 | Gilliem . | |
| 4,153,172 | 5/1979 | Bialobrzeski | 220/720 X |
| 4,386,713 | 6/1983 | Baumeyer et al. | 220/269 |
| 4,403,709 | 9/1983 | Meins et al. | 220/707 X |
| 4,428,498 | 1/1984 | Obey . | |
| 4,560,081 | 12/1985 | Adams | 220/707 X |
| 4,582,213 | 4/1986 | Park et al. | 220/707 |
| 4,712,702 | 12/1987 | Ayabe et al. | 220/707 X |
| 5,518,151 | 5/1996 | Knickerbocker | 222/402.1 X |

FOREIGN PATENT DOCUMENTS

| | | |
|---|---|---|
| 2696720 | 4/1994 | France . |
| 8802548.9 | 6/1988 | Germany . |

*Primary Examiner*—Allan N. Shoap
*Assistant Examiner*—Niki M. Kopsidas
*Attorney, Agent, or Firm*—Jacobson, Price, Holman & Stern, PLLC

[57] ABSTRACT

The container comprises at its mouth a device combined with the internal side of the lid (T) and the opening (3) of the latter, in order to form the emergence, with respect to the mouth of the container (1), of a tubular body (C) which extends as a continuous sheet remaining, at the edge, interleaved between the lid and the body of the container, the product contained in the container (1) coming out directly through the tubular body without contacting the external part of the container.

1 Claim, 7 Drawing Sheets

CONTAINER FOR BEVERAGES, PRESERVED FOODS AND THE LIKE

This invention is concerned with a container for beverages, preserved foods and the like.

As is well known, containers for beverages, especially soft drinks, and for preserved foods and others have, on the lid of the container, indentation lines with a ring-pull tab or imaginary cutting lines for the corresponding cutting implements.

The aforesaid containers for beverages, preserved foods and others display a total lack of hygiene and safety for the user, as it is easy for dust, dirt, germs and others, which could affect users' health, to collect on these containers.

So, whereas old and current beverages containers are fitted with ring-pull tabs and indentation lines, which in the old models are submitted to bending and pulling, tearing these ring-pull tabs which become separated from the container and which define an opening in the lid, and in modern models these ring-pull tabs are submitted by the user to bending which inserts part of them into an opening they make in the lid, and of which they form a part.

In both the aforesaid cases, the user applies his mouth and lips to the opening made in the lid, which may be covered in dust, dirt and germs, whereby he could become infected with some disease. In the second case, corresponding to the more modern model of container, as part of the lid penetrates inside the container, when the user drinks the liquid, as well as applying his mouth and lips to the container as has been described, this liquid, when it comes out, comes into direct contact with said part of the submerged lid, whereby the liquid itself is also contaminated There have been half-hearted attempts to prevent user contact with the container part of the drink, but these have not achieved satisfactory results.

Thus, the U.S. Pat. No. 3,547,308 from GILLIEM LESTER G, presents a drinking tube which incorporates elastic means to push it outwards when the container is opened. These means can be enclosed inside the drinking tube. This method of production complicates the manufacture of the container, and does not allow all the contents of same to be drunk, and does not keep the contents of the container completely contamination free.

The German patent DE-U-88 02 548.9, from LIN GHUAN-SHENG could also be cited, which introduces a container incorporating a straw. It requires a device for attaching the straw, equipped with a concertina, to the container. It complicates manufacture and assembly of the container. It requires parts in different materials. It does not allow all the contents of the container to be drunk. It does not keep the contents of the container contamination-free.

There are other inventions which have tried to solve these problems, likewise for beverages containers, but they have not managed it, such as the patent FP-A-2 696 720 from GRANGEOT, which presents a unit with a neck which, after the flask is opened, is submitted to pulling and protrudes. It does not prevent contamination of the contents, as the actual user drinks from this neck.

There is also the patent U.S. Pat. No. 4,428,498 from OBEY RICHARD, which presents a neck, in a concertina shape, outside the container, to be extended by pulling. This has the drawback that it is completely outside the container and, therefore, does not prevent contamination of the contents when the user drinks.

As far as preserved food containers are concerned, there are two types of opening: one in which the lid of the container is equipped with a ring-pull tab and an indentation line similar to those for the old model of beverages containers, in which the indentation line is positioned around the whole circumference of the lid, and in which the ring-pull tabs are submitted by the user to bending and pulling. The opening made is defined by the indentation line and takes up practically the whole surface of the lid.

The other type of lid is not fitted with any kind of ring-pull tab or indentation line, and the user makes the corresponding opening with suitable independent cutting implements, following an imaginary line very close to the circumference of the lid, with the assistance of the rim of the main body of the container. The opening made is similar to the type with ring-pull tab, but a little larger.

In the said preserved food containers, for both the type fitted with ring-pull tab and indentation line or the type without, the same problem arises, consisting of the fact that while the user Is making the opening in the lid, the liquid—oil or otherwise—contained inside the container floods the lid which has not yet been removed, running over the rim of the container, which is usually covered in dust, dirt, germs, etc. So, whilst the container is being opened, the liquid contained in the product to be consumed is being contaminated, and often the liquid is consumed as well as the preserved product itself.

To date, no account has been taken of the contamination with the risk to the health of users which occurs with consumption of the products conserved in these containers of beverages, preserved foods and others, despite the measures taken to prevent contamination of the foods to safeguard the public health of users.

This invention is concerned with eliminating the aforesaid drawbacks, in such a way that the consumption of beverages, preserved foods and others by the user does not present the slightest risk of contamination, with these products, beverages and/or preserved foods, being kept perfectly hygienic during their consumption, safeguarding the user's health at all times.

This invention is concerned with a container for beverages, preserved foods and similar, which has, in the lid of the container body, indentation lines with ring-pull tabs and/or imaginary cutting lines for independent cutting implements, and it is characterized by the fact that it comprises, in its mouth, a device combined with the lid inside same which, when it is opened, causes the emergence, from the mouth of the container, of a tube, via which the product contained in the container has a direct outlet, without coining into contact with the outside of same.

As per the invention, the tube extends in the form of a continuous strip which is positioned on the rim of the container, between the lid and the main body of the container, and this tube is sealed at its end by a tear-away membrane.

For beverage containers, the tube displays lengthways reinforcements which extend in the continuous strip, which cause the emergence of the tube from the container, when this is opened. The tubular neck can have a partly certain section.

For cans of food, the tube displays continuous folds all round its circumference, of which the outermost folds line defines the tear-away membrane. The continuous folds are arranged all around the main body of the container, at a certain distance from the lid, to prevent them from being cut by the means for cutting the lid when the container is opened.

As per the invention, the tube protrudes from the main body of the container via the action of a springy concertina.

The tube is connected at the bottom to a wrapper concertina which forms part of the lid.

The tube itself may form the concertina.

The tube is sealed at its end by a tear-away membrane which forms part of same. For fizzy beverages, it is the pressure of the actual gas which makes the tube protrude from the main body of the container, the membrane being provided with a small hole which assists the gas to come out and the tube to emerge.

The tube is connected at the bottom to a wrapper sleeve which, at its other end, forms part of the lid. The wrapper sleeve can be extended by the end adjoining the lid by way of a continuous strip which is positioned between the lid and the main body of the container on the rim of the container.

The continuous strip and the lid of the container have at least one reciprocal interlocking point for them to be matched together.

These and other characteristics will be made clearer by the detailed description which follows, to assist which four sheets of sketches accompany, representing a practical case of various methods of production, which is cited solely for illustrative purposes and is not limitative of the scope of this invention.

In the sketches:

FIGS. 1*a,* 1*b* and 1*c* show part elevational and lengthways cross-section views of a beverages container, in the respective positions of closed, opening and tearing away of the tube, FIGS. 2*a,* 2*b* and 2*c* show elevational and part lengthways cross-section views of a beverages container, in the respective positions of closed, opening and tearing away of the tube, FIGS. 2*d* and 2*d* each show part plan views of the tube, FIG. 3 shows a part cross-section view in accordance with plane III—III of FIG. 1*d,*

FIGS. 4*a*, 4*b*, 4*c*, 4*d*, 4*e* and 4*f* show part elevational and perspective views of a preserved food container, in the respective positions of closed, opening and removal of the lid, in perspective cross-section with the continuous membrane ready for tearing away, tearing-away operation of the membrane and torn away, and, FIG. 5 shows another method of production of the preserved food container as per the invention.

In accordance with the sketches, this invention is concerned with a container for beverages, preserved foods or similar, comprising in the mouth a device combined with the lid -T-, at the bottom of same, which, when the container -1- is opened with the means for opening -4- of the lid -T-, causes the emergence from the mouth of the container of a tube -C-, through which the product contained in the container -1- has a direct outlet, without coming into contact with the outside of it.

Figure 1A:
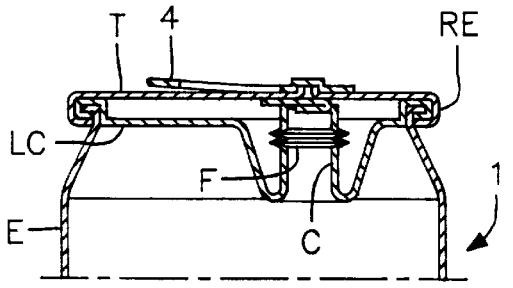
Figure 2A:
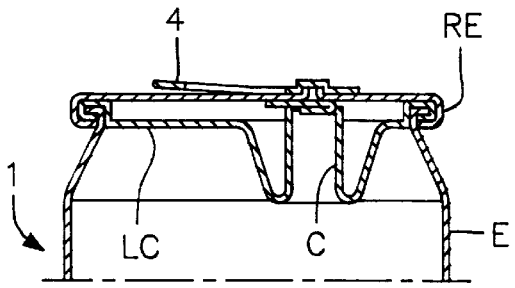
Figure 2B:
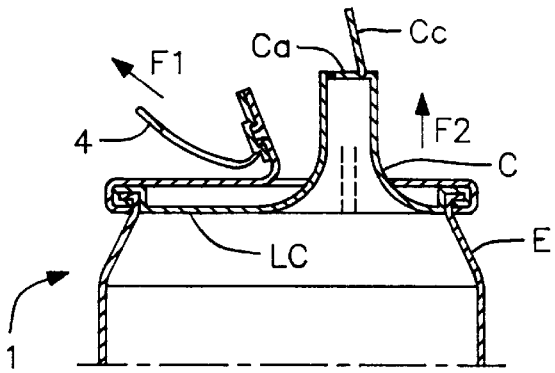
Figure 3:
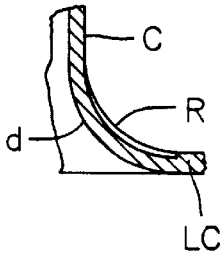
Figure 2D:
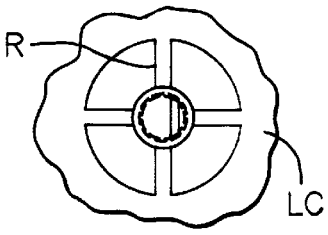

The method of production illustrated in FIGS. 1, 2 and 3 shows that the tube -C- extends in the form of a continuous strip -LC- which, in the formation of the rim -RE- of the container, is positioned between the lid -T- and the main body of the container -E-; this tube -C- is sealed at its end by a membrane -Ca-, which can be torn away via a tube -Cc-.

Figure 1B:
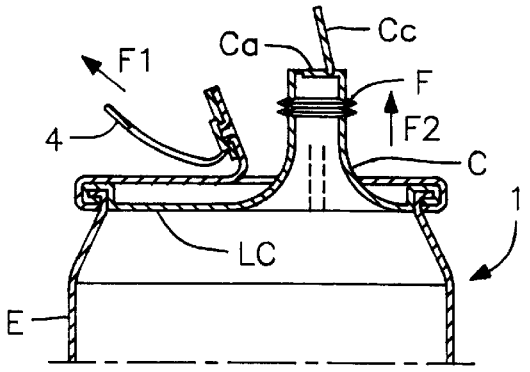

As can be observed in these figures, the beginning of the tube -C- (see FIGS. 1*d*, 3 and 2*d*), displays lengthways reinforcement nerve -R-, or thinning -d- of this beginning, which, when the container -1- is opened, cause or assist the emergence of the tube -C- from the container -1- (see FIGS. 1*b* and 2*b*).

Figure 1C:
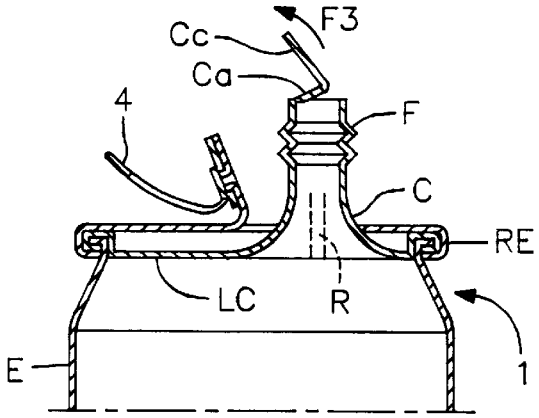
Figure 2C:
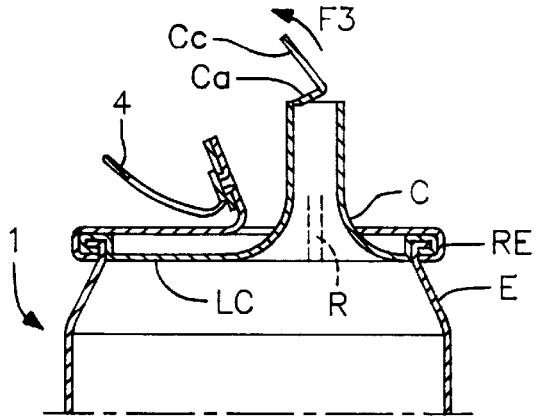
Figure 1D:
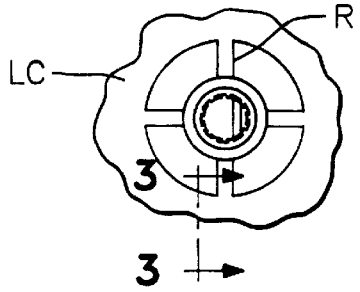

As can be observed from FIGS. 1*a*, 1*b* and 1*c*, the tube -C- can have a concertina-shaped section -F- around the whole of its circumference, enabling the length of the tube to be increased.

Figure 4A:
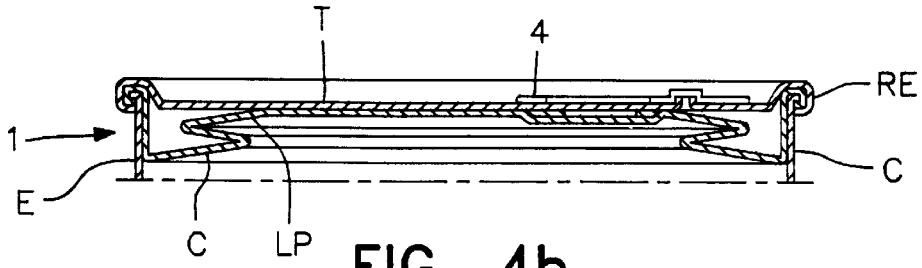
Figure 4B:
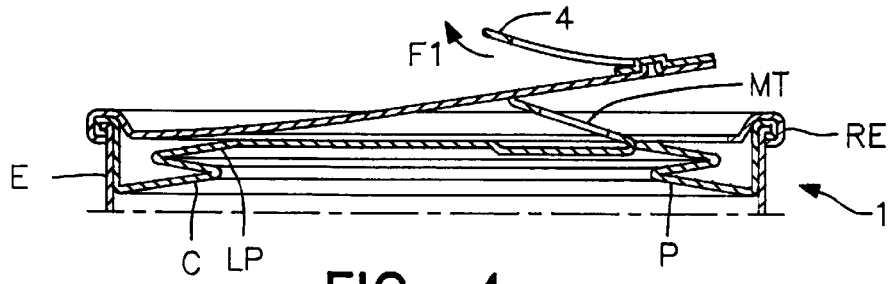
Figure 4C:
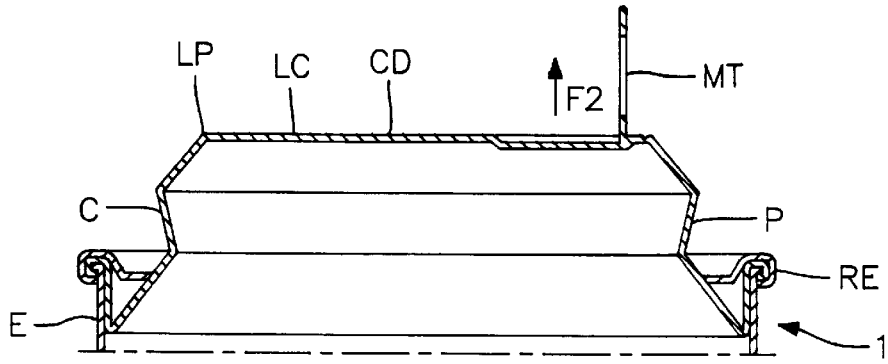
Figure 4D:
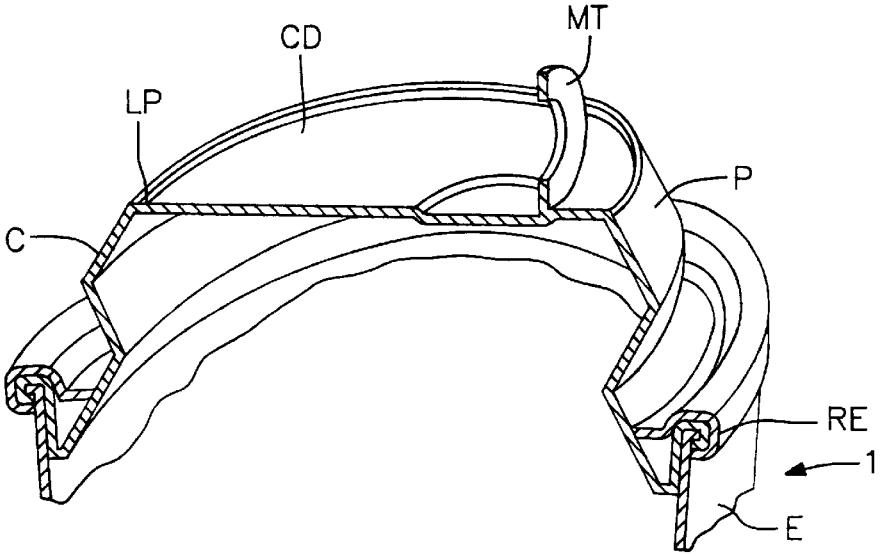
Figure 4E:
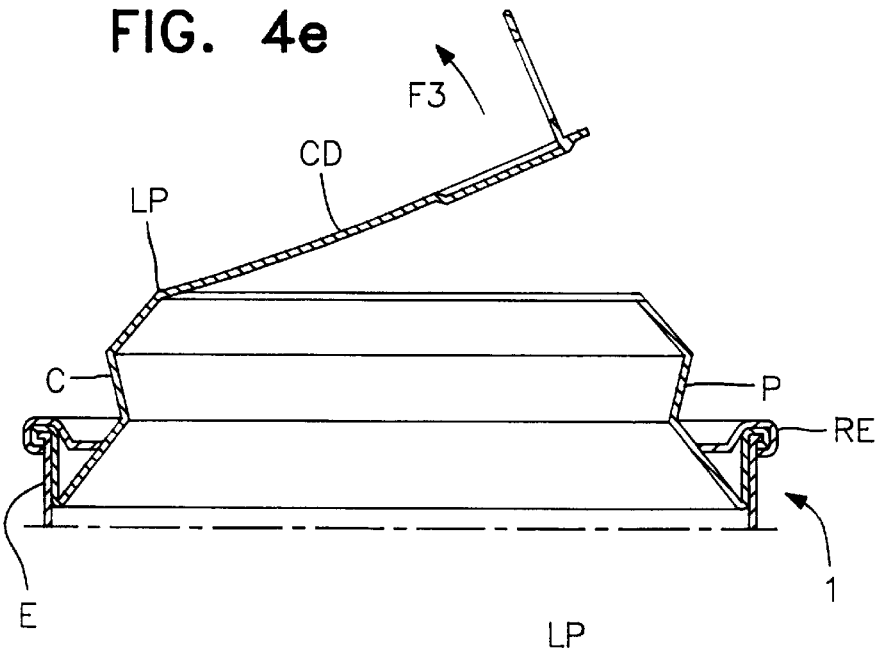
Figure 4F:
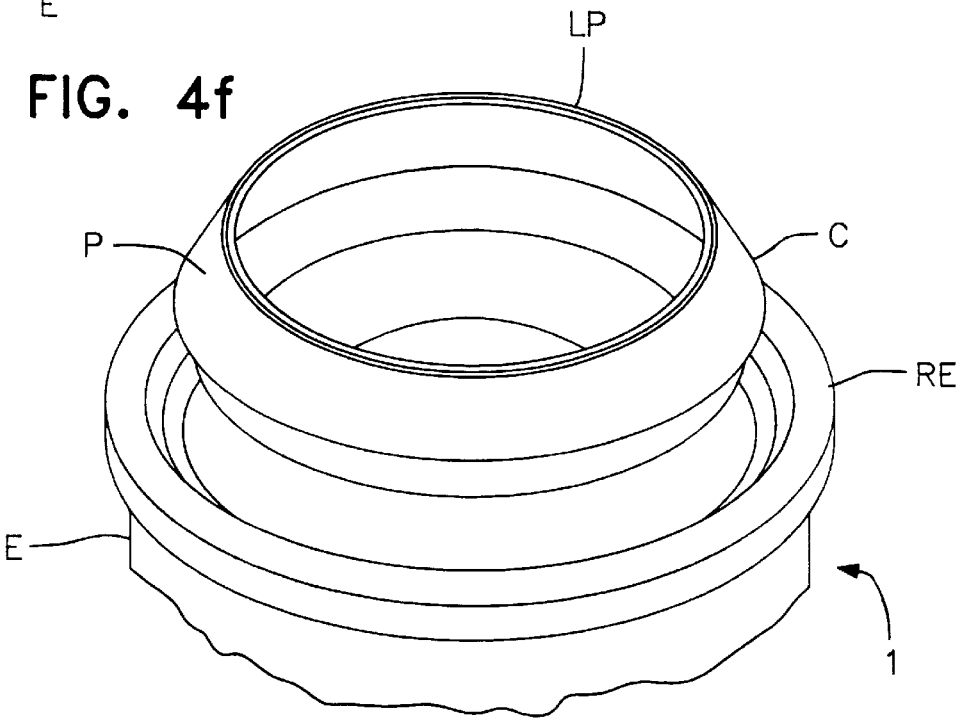
Figure 5:
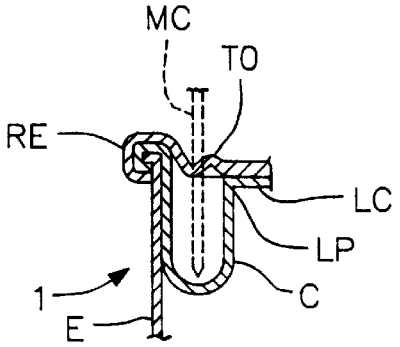

FIGS. 4 and 5 show a method of production of preserved foods containers or similar. In FIGS. 4*a* to 4*f*, the tube displays folds -P- around the whole of its circumference (in a zig-zag), of which the outermost line -LP- defines the tear-away membrane, -CD-, provided with pulling means -MT-, with a ring to pull off this tear-away membrane -CD-.

FIG. 5 illustrates another kind of continuous folds of the tube -C-, which are arranged around the whole of the circumference of the main body -E- of the container at a certain distance from the lid -T-, to prevent them from being cut by the lid-cutting implements -MC-, when the container is opened. This is for cases where the opening is not done using conventional means -4-, but is done rather using the cutting implements -MC-, along an imaginary line close to the rim -RE-. In this case, the lid -T- can incorporate a continuous projection -TO- to assist cutting.

After the tear-away membrane -CD- has been removed, the tube -C- protrudes from the main body of the container -E-, as can be seen in FIG. 4*f*, without there having been any contact between the outside and the contents of the container, whether oil, germs or any other kind. As a result of this, there is not the slightest possibility of contamination of the contents of the container when it is opened.

When the container -1- is in the closed position, beverages containers (FIGS. 1 and 2), or preserved foods (FIGS. 4 and 5) the continuous strip -LC- defining the tube -C- is positioned on the rim -RE- of the container -1-, between the lid -T- and the main body -E- of the container. When the lid -T- of the container is opened using conventional opening means or ring-pull tab -4-, for the beverages containers -1- (FIGS. 1 and 2) or those for preserved foods (FIG. 4), see arrows -F1-, or using cutting implements -MC- for the preserved foods containers (FIG. 5), the tube -C- which, by way of the continuous strip -LC-, covers and isolates the contents of the container -1- from the outside, to prevent contamination of these contents by oil, germs or other, after the lid has been opened, this tube -C- emerges from the container, see arrows -F2-, either by the spring action of the nerves -R- which push the tube -C- outwards, or by ring -MT- on the ring-pull tab. When this tube -C- has emerged, see FIGS. 1*b*, 2*b* and 4*c*, pull -F3- is applied to the flange -Cc- (see FIGS. 1*c* and 2*c*) or to the ring -MT- (see FIG. 4*c*) to tear away and separate the membranes -Ca- (figures to and 2*c*) and -CD- (FIG. 4*e*) which enclose the tube -C-, in order to provide access to the contents of the container, whether these are beverages (FIGS. 1 and 2) or preserved foods (FIGS. 4 and 5), without the slightest risk of contamination of their contents.

The material of the tube and of the continuous membrane forming it should preferably be polyethylene.

The tube -C- for beverages containers can, or need not, incorporate the section -F-. The number and arrangement of folds in the tube -C- for preserved foods containers may be as appropriate.

As per the invention, the container for beverages, preserved foods and similar, with which this invention is concerned, comprises a container -1- for fizzy beverages -B-, illustrated in FIGS. 6 to 11, 18 and 19, consisting of the fact that the inside -T1- of the lid -T- of the main body -E- of the container displays a device which comprises a flexible tube -C- like a straw, the end of which -C1- is joined to this inside -T1- of the lid -T-, a circular concertina -2- which is connected by a flange -2*a*- at the top, outside the circumference of the indentation lines -3-. When the container is -1- is opened, see FIGS. 9 and 10, this tube -C- is caused to come out, like a straw.

The lid -T- FIGS. 6 to 11, 18 and 19 for containers -1- of beverages, preferably fizzy, is provided in the conventional manner, with ring-pull tab -4- and indentation line -3-, said indentation line -3- preferably having one section like a hinge -3*a*-, which enables said ring-pull tab -4- to remain joined to the lid -T- when the container -1- is opened, as can be observed in said FIGS. 9, 10, 11 and 19.

As per this invention, as is illustrated in said FIGS. 6 to 11, 18 and 19, the tube -C- has its free end adjacent to the lid -T- sealed by a tear-away membrane -Ca- which forms part of the straw. Likewise, this straw -C- has indentation lines -Cb- which, when it comes out, break and open the straw or tube -C- (see FIGS. 9, 10 10 and 11 and, in dotted lines, FIG. 19), forming an integral portion, with the sealing membrane -Ca-, of the straw -C-.

The membrane -Ca- can be provided with a small flange -Cc- which assists this breakage.

Figure 6:
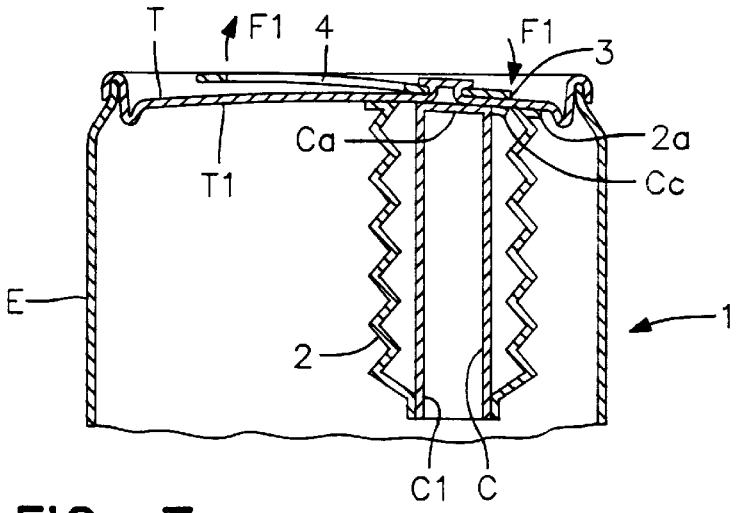
FIG. 6 is a part elevational cross-section views of one method of production or the beverages-container, in the closed position, as per this invention.
Figure 7:
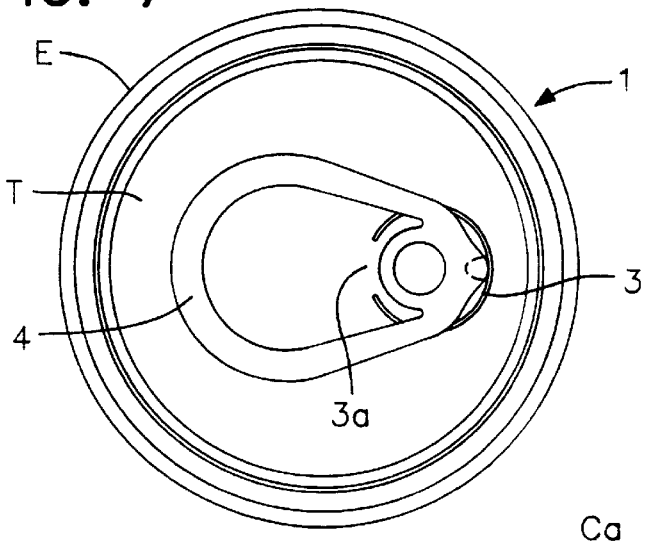
FIG. 7 is a plan view of the closed beverages container, as per the invention.
Figure 8:
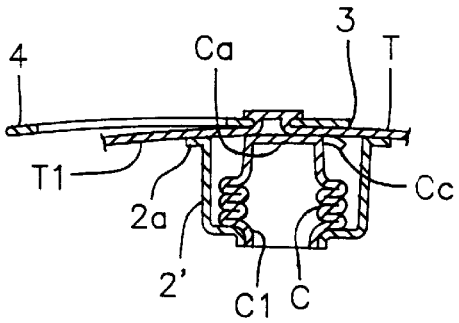
FIG. 8 is a part elevational cross-section view of another method of production of the lid for beverages, in the closed position, as per the invention.
Figure 10:
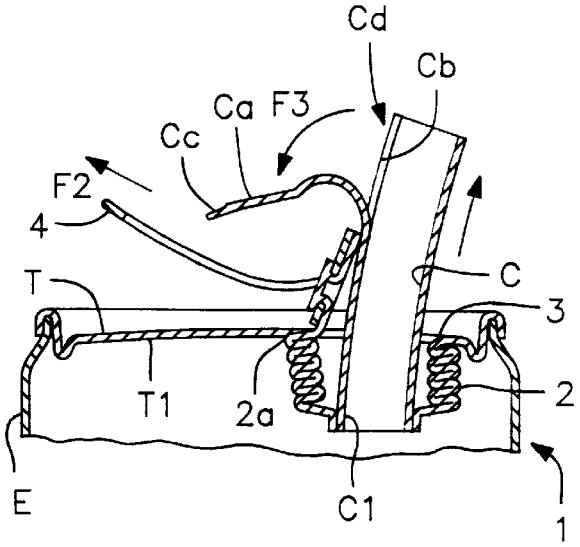
FIG. 10 is a part elevational cross-section view of the container in FIG. 6, in the open position.

As can be seen in FIGS. 6 and 10, a method of production is shown in which the tube -C- (or straw) is connected to the lid by the wrapper concertina -2- forming part of the lid -T-; if said concertina -2- is springy, it can cause the tube -C- to protrude from the main body -E- of the container by springing back. To the contrary, in FIGS. 8, 11 and 18, it is the tube or straw -C- itself Which is concertina-shaped.

The concertina -2- shape of the tube -C-, if it is springy, enables the latter to protrude from the lid -T- by itself.

It should be noted that, as in both cases the tube or straw -C- is sealed at its free end adjacent to the lid -T- by the membrane -Ca, and beverages usually contain gas, it IS the pressure of the actual gas which, when the lid -T- -s opened, pushes the tube or straw -C- outwards (as can be observed in FIGS. 9, 10, 11 and 19). If the beverage is not fizzy, it can be the nature of the concertina, whether the straw -C- or the concertina -2- (see FIG. 6) which makes the tube or straw -C- protrude, and it can even be done by the user himself, by pulling the flange -Cc-. The concertina -2- can consist of a continuous section of the same material as, or different material from, the tube or straw -C-.

Nevertheless, it is necessary to highlight the fact that, as is illustrated in FIGS. 9, 10, 11 and 18, the container -1- when open forms a single unit, as the main body of the container -E- the lid -T- the tribe -C-, the ring-pull tab -4- and the sealing membrane -Ca- are all connected to each other.

Furthermore, the indentation lines -Cb- define an open channel -Cd- in the tube or straw -C-, which makes it easy for the user to drink the contents of the container -1-, because air enters the inside of the main body -E- of the container via this channel -Cd-.

In order for the user to open the container -1-, as is shown by the arrows -F1- in FIG. 6 of the bending of the ring-pull tab -4- and by the arrow -F2- in FIG. 10 for pulling this ring-pull tab, the lid -T- is opened, the tube or straw -C- comes outside and, at the same time, as the membrane -Ca- is joined to the lid -T-, as is indicated by the arrow -F3- in FIG. 10, the membrane -Ca- breaks, enabling the user to drink the contents of the container -1-, by the air entering it via -Cd-.

In this way, neither the user nor the liquid come into any contact with the contaminated outside of the container in question.

Figure 9:
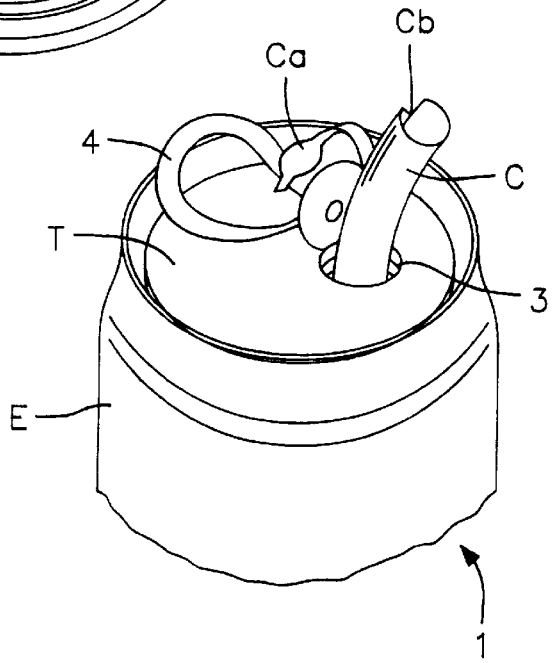
FIG. 9 is a part perspective view of the open beverages container, with the tube protruding outside.
Figure 11:
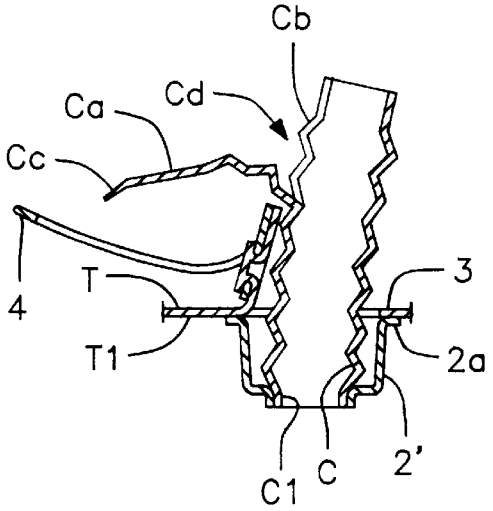
FIG. 11 is a part elevational cross-section view of the lid in FIG. 8, in the open position.
Figure 17:
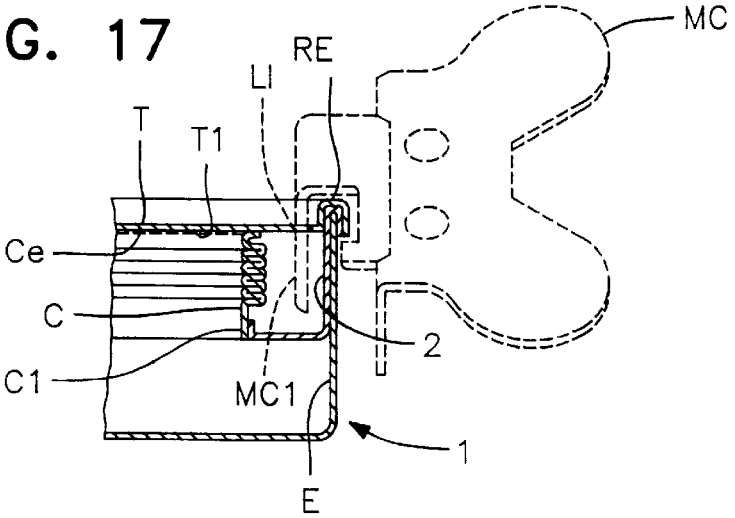
FIG. 17 is a part elevational cross-section view of the container in FIG. 16, with the independent cutting implements.
Figure 18:
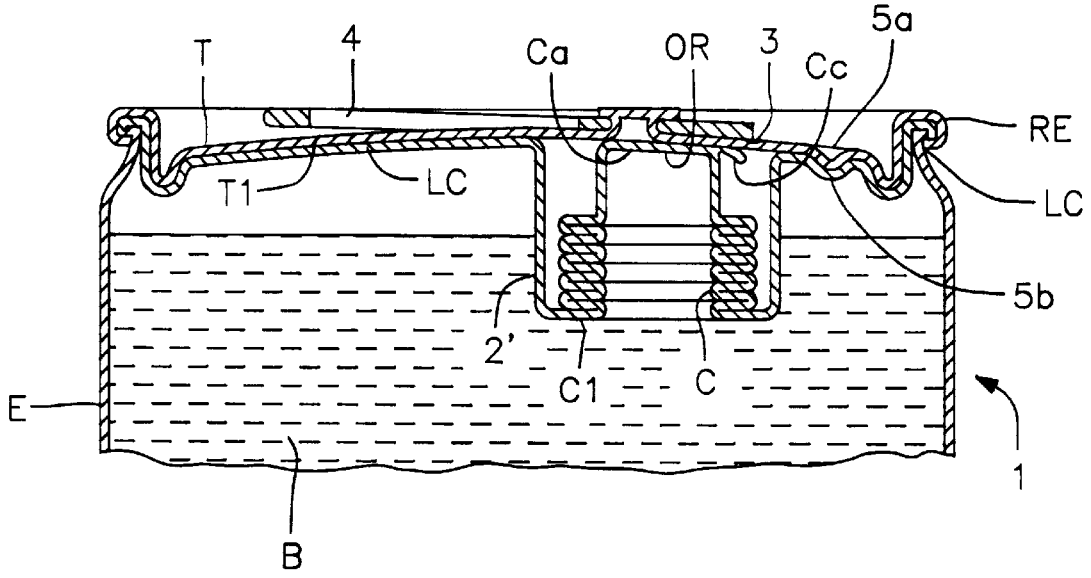
FIG. 18 is a similar view to FIG. 6, of another method of production of the lid as per the invention.
Figure 19:
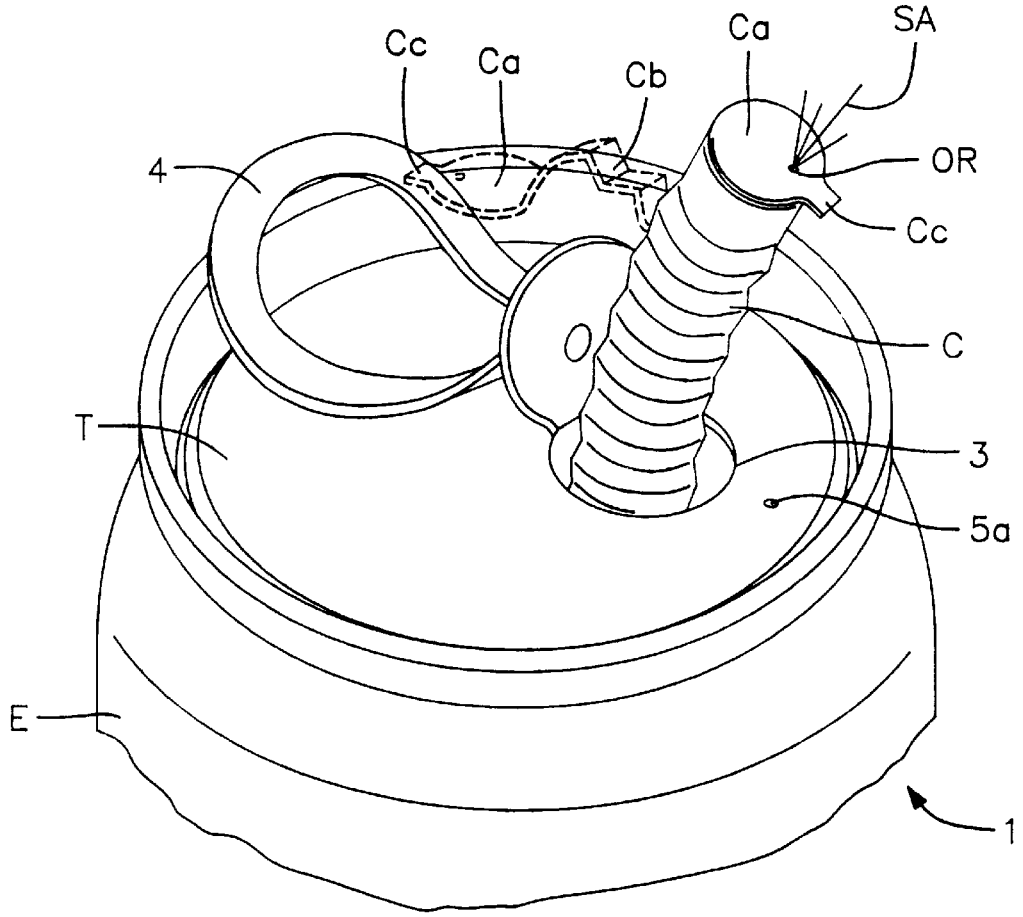
FIG. 19 is a part perspective view of the open container illustrated in FIG. 18.

FIGS. 18 and 19 show another method of production of the lid -T-, which has a wrapper sleeve -2'- (similar to that illustrated in FIGS. 8 and 11 as described, and in FIGS. 12 to 17 which will be described below), and the parts of which of the lid -T- and the tube or straw -C- are as those described in FIGS. 9 and 11. In this method of production, the membrane -Ca- is provided with a small hole -OR- which, when the lid -T- is opened, assists the gas under pressure inside the container -E- to start to come out -SA-, and assists the emergence or the tube or straw -C- from the opening of the lid -T-.

Likewise, this method of production is planned so that the wrapper sleeve -2'-, to which the tube or straw -C- is joined at the bottom, by the end adjoining the lid -T- and adjacent to its inside -T1-, is prolonged by a continuous strip -LC- which, in the construction of the container in question -E-, is positioned on the rim -RE- of the container, between the lid -T- and the main body -1- of the container (see FIG. 18).

The aforesaid production method illustrated in FIGS. 18 and 19 is planned so that, in the lid -T- of the container -E- and in the continuous strip -LC- forming part of the tube or straw -C- and of the wrapper sleeve -2'-, provision is made of one or more reciprocal interlocking points -5*a*- and -5*b*- to assist their mutual latching up in the assembly of the lid. In this method of production, the tube or straw -C-, the sleeve -2'- and the continuous strip -LC- are of a piece of material which is adequate to present certain specific characteristics.

FIGS. 12 to 15 show a container -1- of preserved food, fitted with ring-pull tab and indentation line. As in the case described above for a container for beverages, the tube -C- is in the form of a concertina and is provided with indentation lines -Ce- next to the lid -T- of the container -1-, which break when the lid -T- is opened, with the tube -C- rising up at the same time in the form of a concertina, as is illustrated in the aforesaid FIG. 14, the tube being connected at the bottom to a wrapper sleeve -2'- which, at its other end -2*a*- forms part of the lid -T-.

Figure 12:
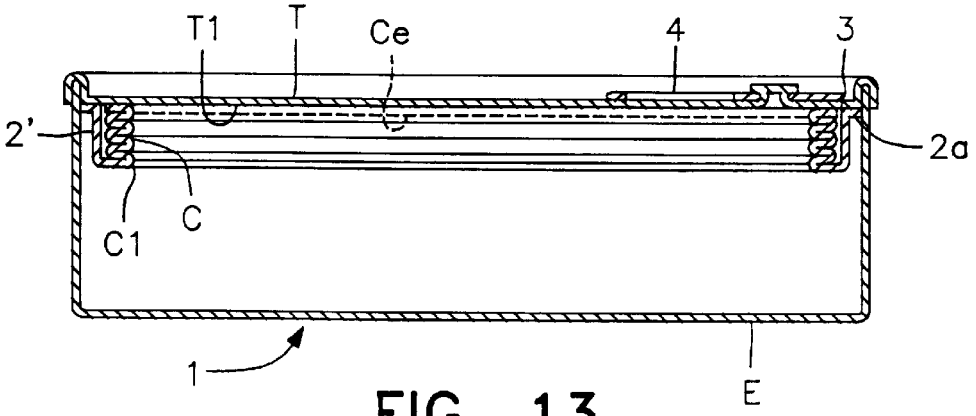
FIG. 12 is an elevational cross-section view of one method of production of the preserved foods container, provided with ring-pull tab and indentation line, in the closed position, as per this invention.
Figure 13:
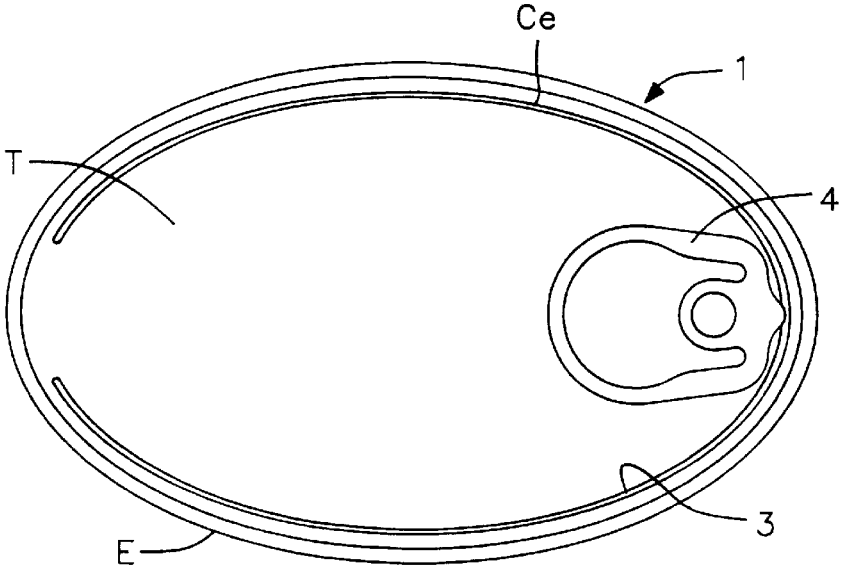
FIG. 13 is a plan view of FIG. 12.
Figure 14:
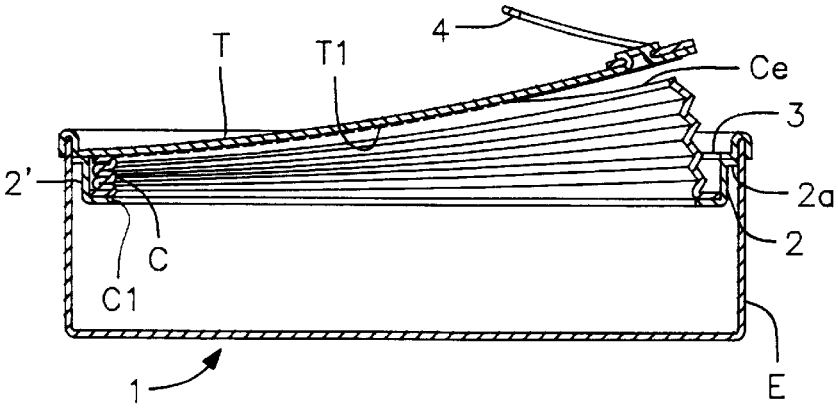
FIG. 14 is an elevational cross-section view of the container shown in FIG. 12, in a partly-opened position.
Figure 15:
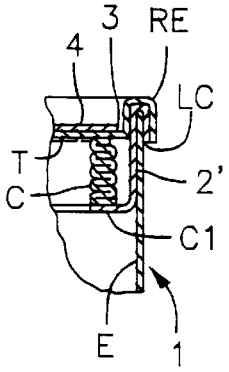
FIG. 15 is a part elevational cross-section view of another method of production of the lid, as per the invention.

FIG. 15 shows another method of production in respect of the method of production illustrated in FIG. 12, and which consists of the tube -C- being joined to the container -1- by way of a wrapper sleeve -2'- in material other than that of the tube and of a suitable nature, enabling it to be positioned between the lid -T- and the main body -E- of the container to form the rim -RE- of the container -I-, as has been described in FIG. 18. The said sleeve -2'- of different material, which joins the tube -C- to the lid -T-, can be provided in other methods of production, such as is illustrated in FIG. 14.

Figure 16:
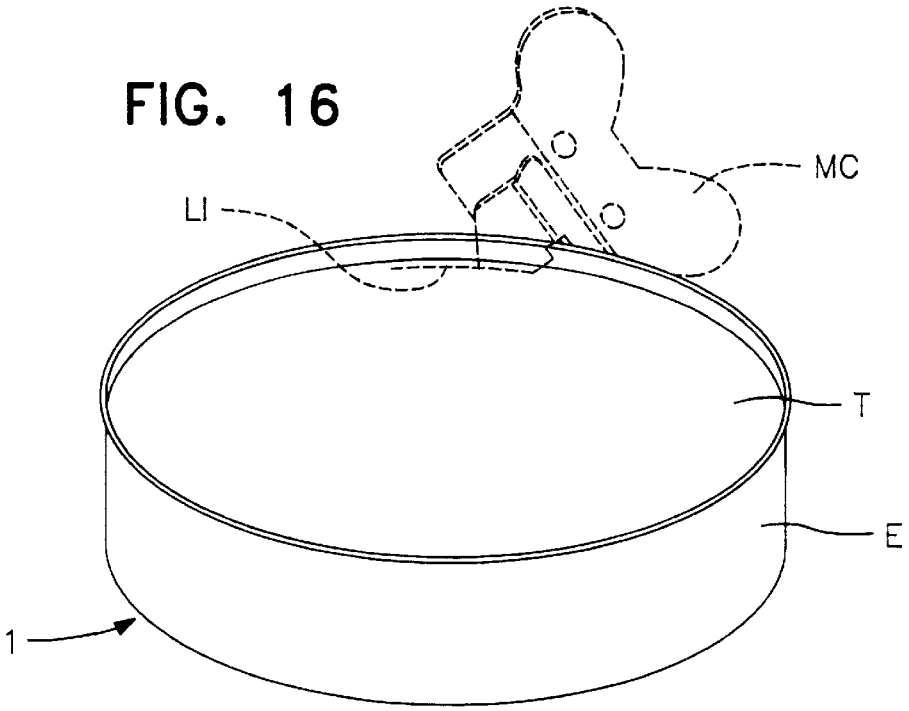
FIG. 16 is a perspective view of a preserved food container, not provided with ring-pull tab or indentation line, and which shows independent cutting implements.

FIGS. 16 and 17 illustrate a method of production of the container -1- for preserved foods, without ring-pull tab and indentation lines and which, for it to be opened, requires independent cutting implements -MC- of any kind, whether automatic or manual, such as those illustrated and which make the cut in the lid -T- along imaginary lines -L1- next to the circumference of the lid -T- and the rim of the container -1-. As can be observed in greater detail in FIG. 17, the wall of the tube -C- is sufficiently separated from the wall of the main body -E- of the container, to allow the action of the cutting implements -MC-, without the cutting edge -MC1- being able to affect the tube -C- during cutting.

In this method of production, the join of the tube -C- to the lid -T- is made by way of a wrapper sleeve -2'-, preferably in a different material to that of the tube -C-, which enables it to be positioned between the lid -T- and the main body -E- of the container, to form the rim -RE- of the container -1-, as is illustrated in full detail in FIG. 17, which is similar to FIG. 15. This is due to the fact that, in order to form the said rim, -RE-, the material used needs to have certain properties.

To sum up, this invention introduces a hygienic protective device for containers for beverages, preserved foods and similar, which enables the hygienic state of the preserved beverages and foods to be maintained in perfect conditions during the opening of these cans and consumption by the user, without any risk to the user's health, as it enables the direct outlet of the product contained in the container, without contact with the outside of same.

I claim:

1. Container for beverages comprising:

a container lid having indentation lines and a tear-away means including a pull ring and a continuous single-part strip, a periphery of the continuous strip being interposed between the lid and a mouth of a container body, the lid and the mouth of the container body making up a container rim, said continuous single-part strip including a tubular body positioned against the container lid and being closed at one end by a tear-away continuous membrane provided with a pull flange, said tubular body forming an outlet projecting from the container through a lid opening formed by said tear-away means so that a liquid contained in the container is removable from the container through the tubular body projecting through said lid opening when the continuous membrane is torn-away by the pull flange, and whereby when the container lid is opened by the tear-away means, a portion of the container lid and the flange are kept interlocked and integrally joined to the container body, the tubular body including a free end having a sidewall and parallel longitudinal indentation lines in said sidewall for tearing the sidewall which when the pull flange is pulled, the continuous membrane is torn away along with a portion of said sidewall of the tubular body and an open channel at the free end of the tubular body is defined allowing access of air into the container and the user can thus more easily empty contents of the container through the tubular body.

* * * * *